US006029460A

United States Patent [19]

Ji

[11] Patent Number: 6,029,460

[45] Date of Patent: Feb. 29, 2000

[54] METHOD FOR CONTROLLING COOL AIR DISPERSING OPERATION OF A REFRIGERATOR

[75] Inventor: Joon Dong Ji, Suwon, Rep. of Korea

[73] Assignee: Samsung Electronics Co., Ltd., Suwon, Rep. of Korea

[21] Appl. No.: 09/162,063

[22] Filed: Sep. 29, 1998

[30] Foreign Application Priority Data

Sep. 30, 1997 [KR] Rep. of Korea ..... 97-50537

[51] Int. Cl.[7] ..... F25D 17/08

[52] U.S. Cl. ..... 62/89; 62/187; 62/408

[58] Field of Search ..... 62/89, 187, 408, 62/419, 426

[56] References Cited

U.S. PATENT DOCUMENTS

| | | | |
|---|---|---|---|
| 5,735,138 | 4/1998 | Park et al. | 62/419 |
| 5,755,112 | 5/1998 | Kang | 62/419 |
| 5,778,688 | 7/1998 | Park et al. | 62/89 |
| 5,799,500 | 9/1998 | Kang | 62/408 |
| 5,802,867 | 9/1998 | Kang | 62/408 |
| 5,884,491 | 3/1999 | Kim et al. | 62/89 |
| 5,907,953 | 6/1999 | Kang et al. | 62/89 |
| 5,918,479 | 7/1999 | Ji et al. | 62/187 |

*Primary Examiner*—William E. Tapolcai
*Attorney, Agent, or Firm*—Burns, Doane, Swecker & Mathis, L.L.P.

[57] ABSTRACT

Disclosed is a method of controlling a cool air dispersing operation of a refrigerator for maintaining the temperature in a cooling compartment uniform. Many horizontal dispersing blades and vertical dispersing blades of planar plate shape, which respectively control the horizontal and vertical discharge directions of cool air are installed in a cool air duct. The blades are continuously rotated while a deviation of temperature in the cooling compartment is smaller than a predetermined value, whereby the cool air in the cooling compartment is successively supplied into the respective areas in the cooling compartment. Meanwhile, if the deviation is greater than the predetermined value, the blades are stopped at a specific position so that the cool air is discharged toward an area of which temperature is high. Thus, the temperature in the cooling compartment becomes uniform in a short period of time. Further, no vortex of cool air is generated since the blades are shaped into a planar plate.

3 Claims, 15 Drawing Sheets

METHOD FOR CONTROLLING COOL AIR DISPERSING OPERATION OF A REFRIGERATOR

BACKGROUND OF THE INVENTION

1. Field of the Invention

The present invention relates to a method for controlling cool air dispersing operation of a refrigerator, and more particularly, to a method for controlling cool air dispersing operation of a refrigerator having horizontal dispersing blades and vertical dispersing blades for respectively dispersing cool air supplied into a cooling compartment horizontally and vertically.

2. Prior Art

In general, a refrigerator has a cabinet for forming a pair of cooling compartments, i. e., a freezing compartment and a fresh food compartment which are partitioned by a partitioning wall, a freezing compartment door and a fresh food compartment door for opening/closing the cooling compartments respectively, and a cooling system for supplying the freezing compartment and the fresh food compartment with cool air which is comprised of a compressor, a condenser and an evaporator. The cool air generated by the evaporator flows along a cool air duct formed in a rear wall of each compartment, and then is supplied into each cooling compartment by a blowing fan through cool air discharge ports opened thereinto.

In such a conventional refrigerator, however, there exist an area on which the cool air discharged through the cool air discharge ports is concentrated, and an area to which a relatively small amount of cool air is supplied, so there occurs a deviation of temperature in the cooling compartments and uniform cooling cannot be achieved. Therefore, the refrigerator adopting so called tri-dimensional cooling method which has amended such a problem has been proposed. In the refrigerator adopting the tri-dimensional cooling method, the cool air discharge ports are provided at both side walls as well as at the rear wall of the cooling compartment in order to promote the uniform cooling.

However, in such a refrigerator adopting the tri-dimensional cooling method, since the cool air is discharged through the cool air discharge ports in fixed directions, there may be a dead-zone at an edge area which is not supplied with the cool air sufficiently. In particular, since the cool air duct has to be provided not only in the rear wall but also in the side walls, there are problems that the space for storing food is reduced and the manufacturing cost increases due to the increased number of components and processes.

The uniform distribution of cool air has risen to an important problem in relation to the trend to use large-sized refrigerator.

In consideration of such a problem, the applicant of this invention has proposed a refrigerator having a device for dispersing cool air in International Patent Application WO 95/27278. FIGS. 1 through 3 are a side view, a partial enlarged sectional view, and an exploded perspective view of main elements of the refrigerator having the device for dispersing cool air.

The conventional refrigerator having the device for dispersing cool air has a pair of cooling compartments 2 and 3 in a cabinet 1 with hexahedral shape, which are partitioned from each other by a partitioning wall 5. The cooling compartments 2 and 3 are called a freezing compartment 2 of relatively low temperature and a fresh food compartment 3 of relatively high temperature. On the front opening of the cooling compartments 2 and 3, doors 6 and 7 for opening/closing them are installed respectively. In the cabinet 1 is installed a cooling system comprising a compressor 11, a condenser (not shown), a freezing compartment evaporator 12*a*, and a fresh food compartment evaporator 12*b*. The cool air generated from the evaporators 12*a* and 12*b* is supplied to the corresponding compartments 2 and 3 by a freezing compartment fan 13*a* and a fresh food compartment fan 13*b* respectively.

A duct plate 9 of partial cylinder shape having cool air discharge ports 16 opened to the fresh food compartment 3 is attached to an inner wall plate 23 forming a rear inner wall surface of the fresh food compartment 3, and a cool air duct 15 and a circulation duct 17 separated from each other by a seal plate 25 are provided between the duct plate 9 and a rear wall 4 of the cabinet 1. In the cool air duct 15 is installed a duct member 21 for guiding the cool air blown by the fresh food compartment fan 13*b* downwardly. The cool air generated by the fresh food compartment evaporator 12*b* is blown by the fresh food compartment fan 13*b*, and then supplied to the fresh food compartment 3 via the cool air duct 15 and the cool air discharge ports 16.

A cool air dispersing device 130 is installed in the cool air duct 15. The cool air dispersing device 130 is comprised of a rotational shaft 131 having a vertical axis, cool air dispersing blades 132 assembled with the rotational shaft 131 at areas adjacent to the cool air discharge ports 16 respectively, and a driving motor 135 for rotating the rotational shaft 131. Each of the cool air dispersing blades 132 is comprised of three discs 136, 137 and 138 disposed in parallel with each other along the axis direction, and a first blade part 133 and a second blade part 134 disposed between the discs 136, 137 and 138. Each of the blade parts 133 and 134 are bent so that their cross section is a lax shape of alphabet S. The blade parts 133 and 134 are bent to the opposite directions to each other.

In the refrigerator having the above-described constitution, when the driving motor 135 rotates the rotational shaft 131 at a low speed, the cool air flowing along the cool air duct 15 changes its flowing direction along the bent surface of the cool air dispersing blades 132, and is discharged into the fresh food compartment 3 to be dispersed horizontally. Meanwhile, when the concentrative cooling on a specific area is needed, the driving motor 135 stops the rotational shaft 131 in accordance with the direction of the cool air dispersing blades 132.

However, since the blade parts 133 and 134 of the cool air dispersing device 130 are bent to be shaped into the lax alphabet S, the smooth flow of cool air may be impeded by a vortex of the cool air formed about the cool air discharge ports 16.

Moreover, although such a conventional cool air dispersing device 130 can achieve the uniform distribution of the cool air horizontally, the vertical distribution of the cool air has not been uniform, so there is a limitation in realizing the uniform cooling throughout the overall area of the fresh food compartment 3.

SUMMARY OF THE INVENTION

The present invention has been proposed to overcome the above-described problems in the prior art, and accordingly it is the object of the present invention to provide a method for controlling a cool air dispersing operation of a refrigerator, capable of preventing vortex of cool air and achieving effectively the uniform distribution of cool air both horizontally and vertically.

To achieve the above object, the present invention provides a method for controlling a cool air dispersing operation of a refrigerator, comprising the steps of: preparing a duct housing forming a cool air duct for guiding cool air generated by an evaporator, said duct housing having a plurality of cool air discharge ports open into a cooling compartment, a plurality of horizontal dispersing blades of planar plate shape being installed in said cool air duct so as to be capable of rotating with respect to a vertical axis, said horizontal dispersing blades for controlling a horizontal discharge direction of the cool air supplied into said cooling compartment, and a plurality of vertical dispersing blades of planar plate shape being installed in said cool air duct so as to be capable of rotating with respect to a horizontal axis, said vertical dispersing blades for controlling a vertical discharge direction of the cool air supplied into said cooling compartment; sensing temperatures of a predetermined number of positions in said cooling compartment; calculating a deviation of the temperatures in said cooling compartment on the basis of the sensed temperature; supplying the cool air in said cool air duct successively to respective areas in said cooling compartment by rotating said horizontal dispersing blades and said vertical dispersing blades continuously, while the deviation is smaller than a predetermined value; and stopping said horizontal dispersing blades and said vertical dispersing blades so that the cool air is discharged toward an area of which temperature is high, when the deviation is greater than the predetermined value.

It is preferable that said vertical dispersing blades are reciprocally rotated within a predetermined angular range as said horizontal dispersing blades are rotated. Furthermore, it is more preferable that said vertical dispersing blades are controlled so as to reciprocate one time while said horizontal dispersing blades rotate one time.

According to the present invention, the vortex of the cool air about the cool air discharge ports does not occur. Further, since the discharge direction of the cool air is continuously changed by the combinational operation of the horizontal dispersing blades and the vertical dispersing blades, the cool air is distributed uniformly throughout the overall area of the cooling compartment. In particular, the area of which temperature has risen can be cooled in a concentrative manner, so the temperature in the cooling compartment becomes uniform in a short period of time.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Figure 1:
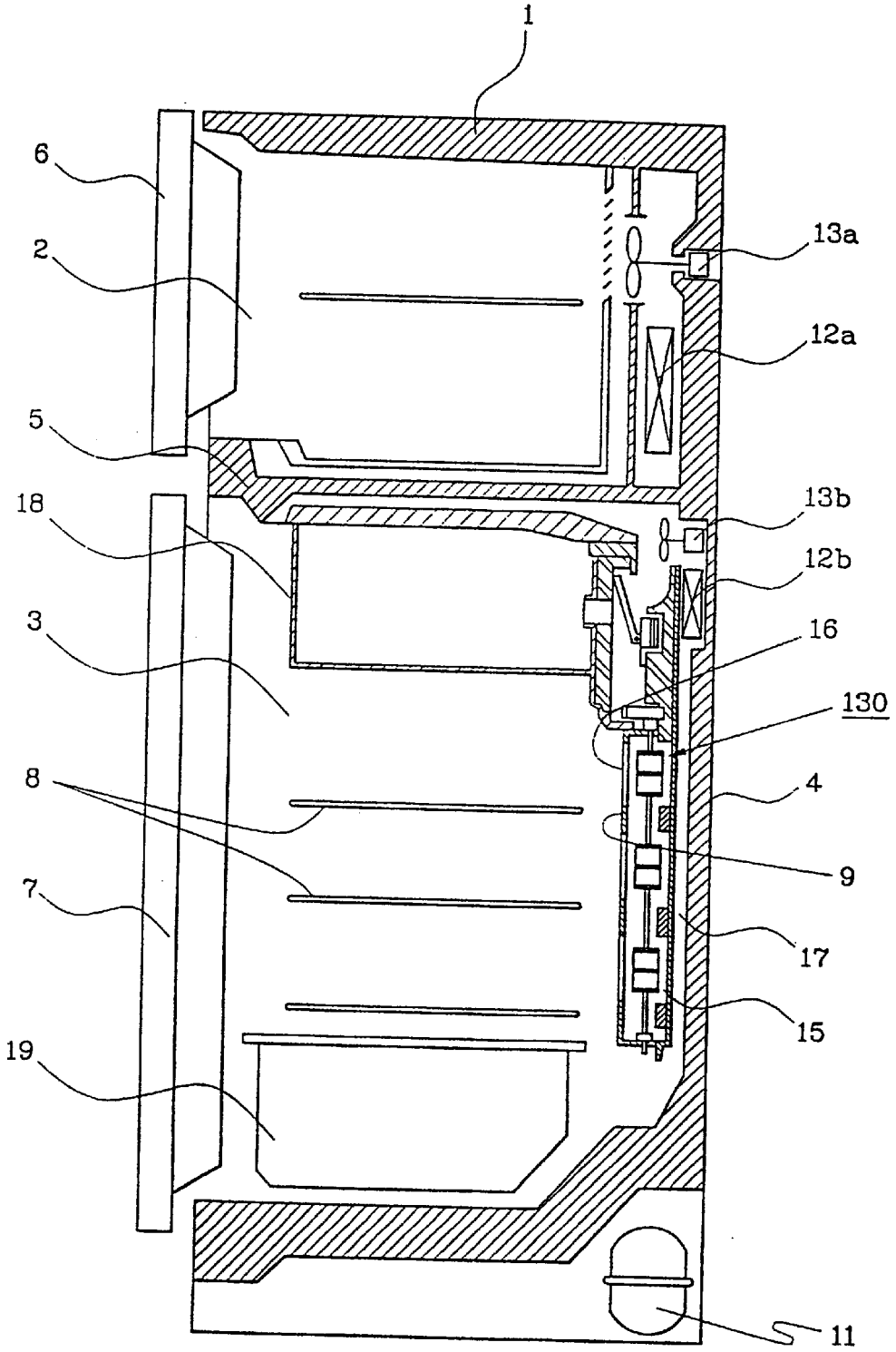
FIG. 1 (PRIOR ART)
FIG. 1 is a side sectional view of a conventional refrigerator having cool air dispersing blades.
Figure 2:
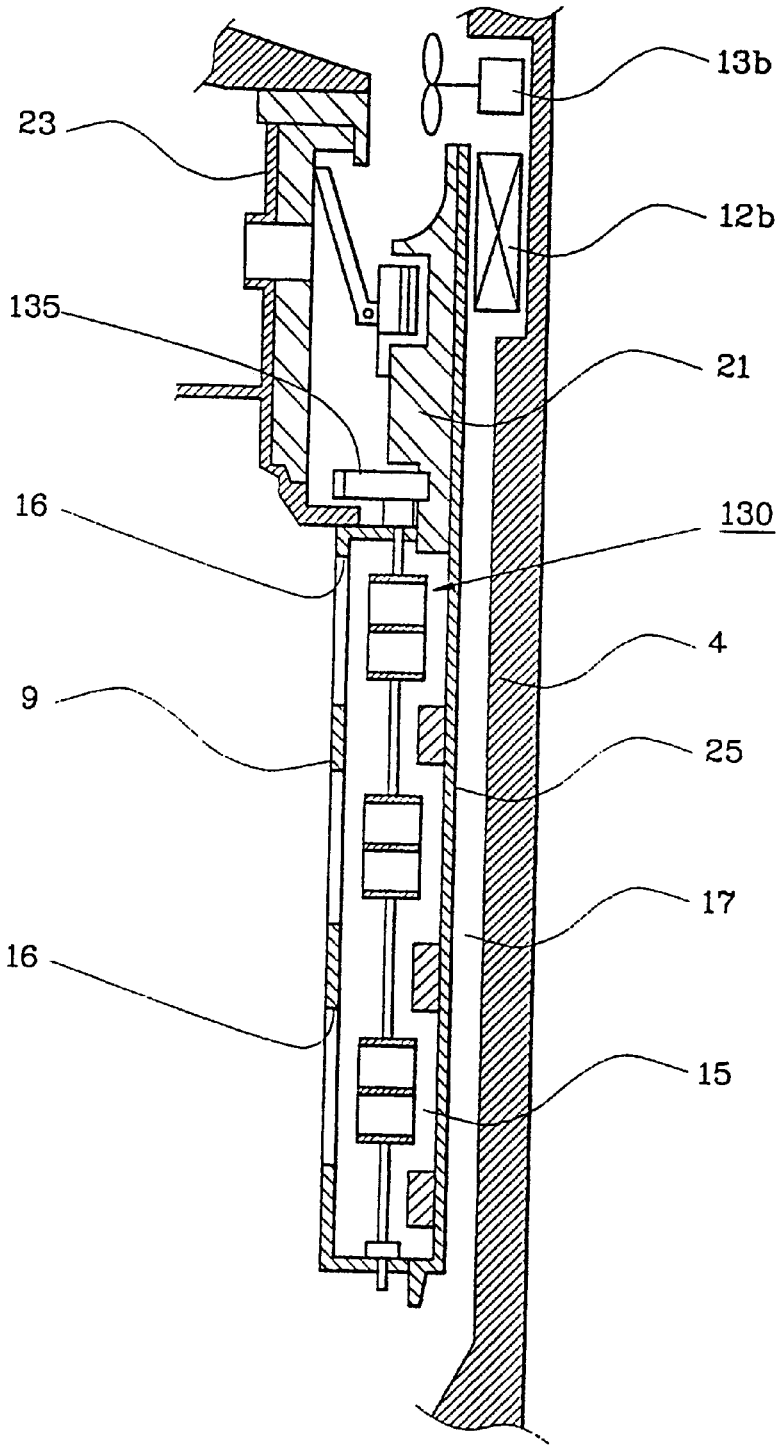
FIG. 2 (PRIOR ART)
FIG. 2 is a partial enlarged sectional view of FIG. 1.
Figure 3:
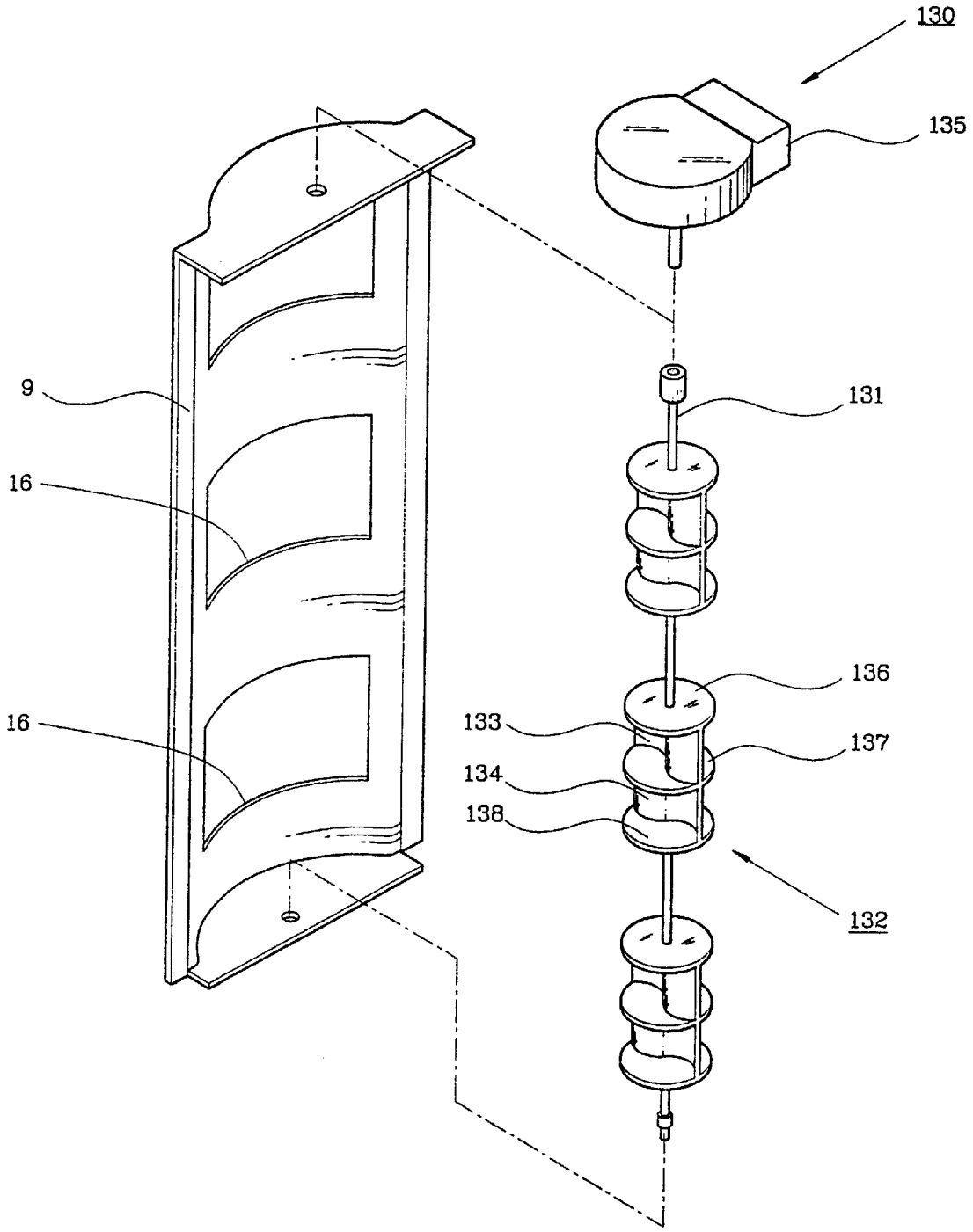
FIG. 3 (PRIOR ART)
FIG. 3 is an enlarged exploded perspective view of main elements of FIG. 2.

Hereinafter, the present invention will be described in detail with reference to the accompanying drawings. Parts identical to those in the conventional refrigerator shown in FIGS. 1 through 3 will be referred to with the same reference numerals.

Figure 4:
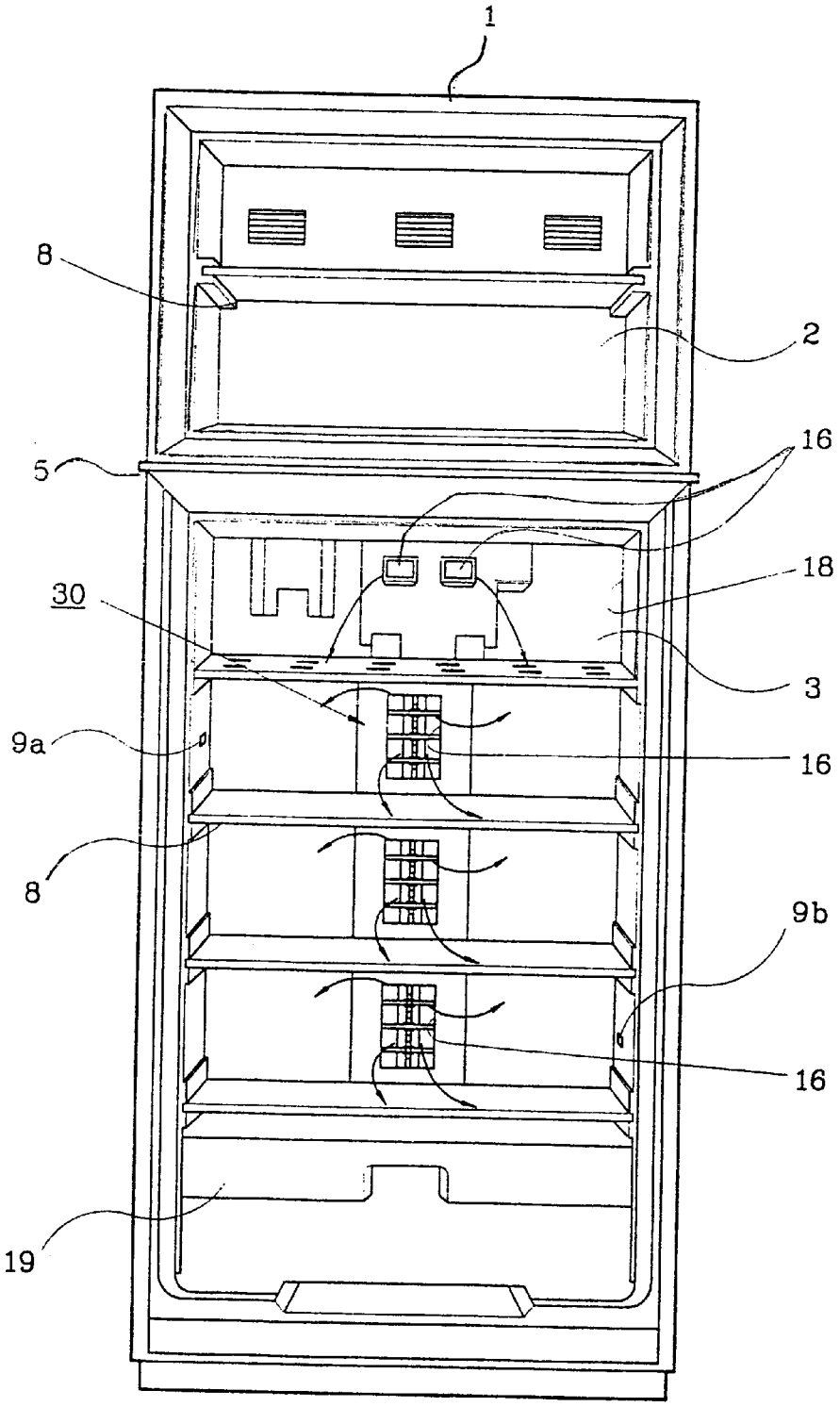
FIG. 4 is a front view of a refrigerator according to the present invention.
Figure 5:
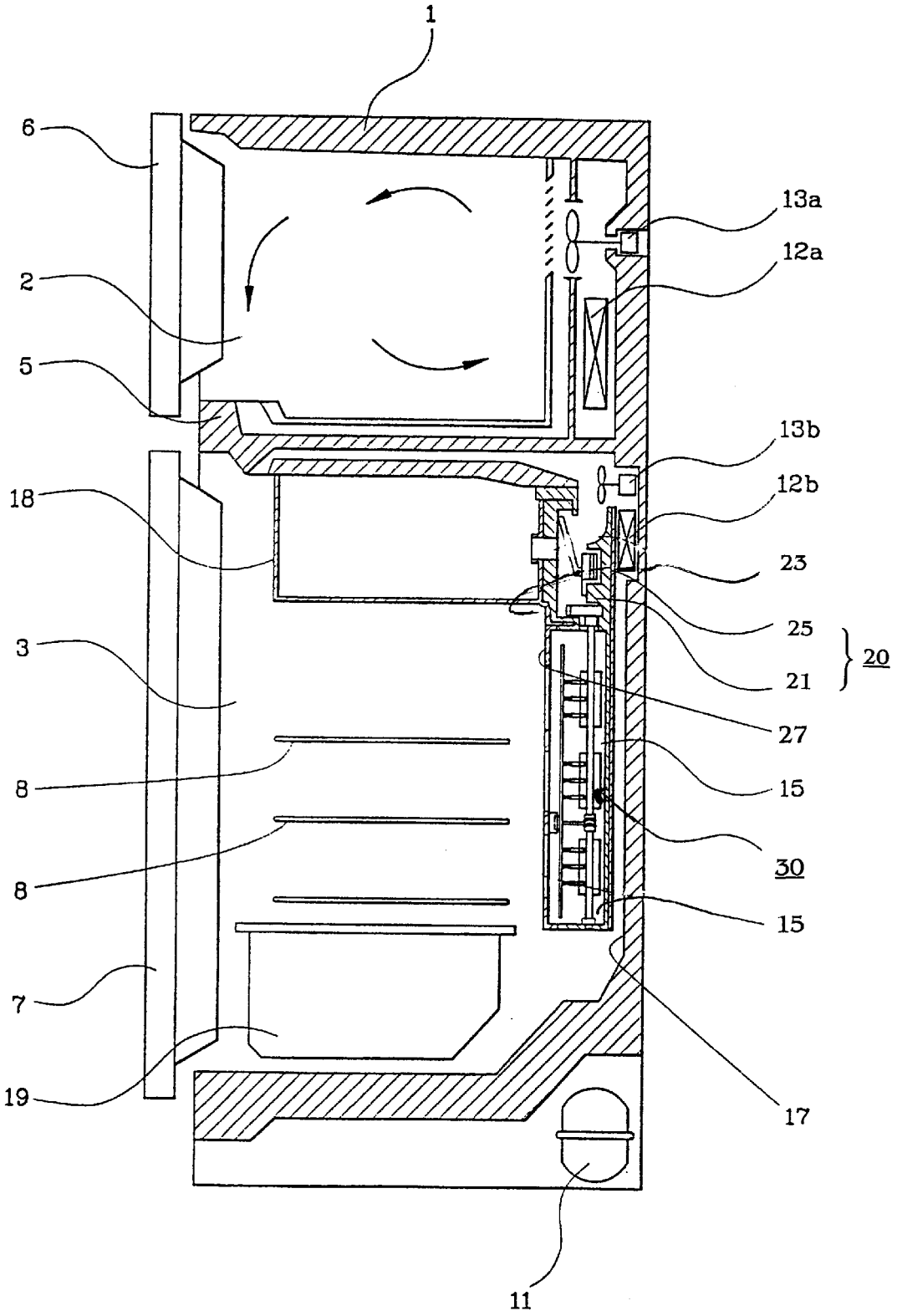
FIG. 5 is a side sectional view of FIG. 4.

FIG. 4 is a front view of a refrigerator according to the present invention, and FIG. 5 is a side sectional view of FIG. 4. The refrigerator has, as the conventional refrigerator which has been illustrated with reference to FIGS. 1 through 3, a cabinet 1 forming freezing compartment 2 and a fresh food compartment which are partitioned by a partitioning wall 5. On the front openings of the freezing compartment 2 and the fresh food compartment 3, doors 6 and 7 for opening/closing them are installed respectively. In the fresh food compartment 3, shelves 8 for placing food thereon are installed, which divide the fresh food compartment 3 into three stratified area, i. e., an upper area, a middle area, and a lower area. A special fresh chamber 18 for storing food which are proper to a specific temperature range is formed at the upper part of the fresh food compartment 3, and a vegetable chamber 19 for storing vegetables is formed at the lower part of the fresh food compartment 3.

A pair of temperature sensors 9*a* and 9*b* are installed in the fresh food compartment 3. The temperature sensors 9*a* and 9*b* are respectively installed on the upper left area and the lower right area of in the fresh food compartment 3.

In the cabinet 1 is installed a cooling system comprising a compressor 11, a condenser (not shown), a freezing compartment evaporator 12*a*, and a fresh food compartment evaporator 12*b*. The cool air generated by the evaporators 12*a* and 12*b* is supplied into the corresponding cooling compartments 2 and 3 by the freezing compartment fan 13*a* and the fresh food compartment fan 13*b*.

A duct housing 20 for forming a cool air duct 15 providing a passage of cool air supplied from the evaporator 12*b* is installed on the rear area of the fresh food compartment 3. The duct housing 20 comprises a duct member 21 for forming the cool air duct 15, a front plate 23 attached to the front side of the duct member 21, a seal plate 25 attached to the rear side of the duct member 21, and a duct cover 27 having the shape of a partial cylinder and installed at the lower side of the front plate 23.

A plurality of cool air discharge ports 16 open toward the fresh food compartment 3 are provided on the duct cover 27 along the longitudinal direction thereof by a predetermined interval therebetween. The duct cover 27 protrudes to the inside of the fresh food compartment 3. Thus, the duct cover 27 and the cool air dispersing device 30 protrude a little from the rear wall of the fresh food compartment 3, whereby the cool air guided by the cool air dispersing device 30 is dispersed into the fresh food compartment 3 within a great angular range.

The duct cover 27 and the duct member 21 form the cool air duct 15 therebetween for guiding the movement of the cool air, and the cool air dispersing device 30 is installed in the cool air duct 15. The cool air dispersing device 30 which will be described later in detail supplies the cool air blown by the fresh food compartment fan 13*b* into the fresh food compartment 3. A circulation duct 17 connecting the fresh food compartment 3 and the fresh food compartment evaporator 12*b* is formed separately from the cool air duct 15. The air in the fresh food compartment 3 is circulated to the fresh food compartment evaporator 12*b* through the circulation duct 17.

Figure 6:
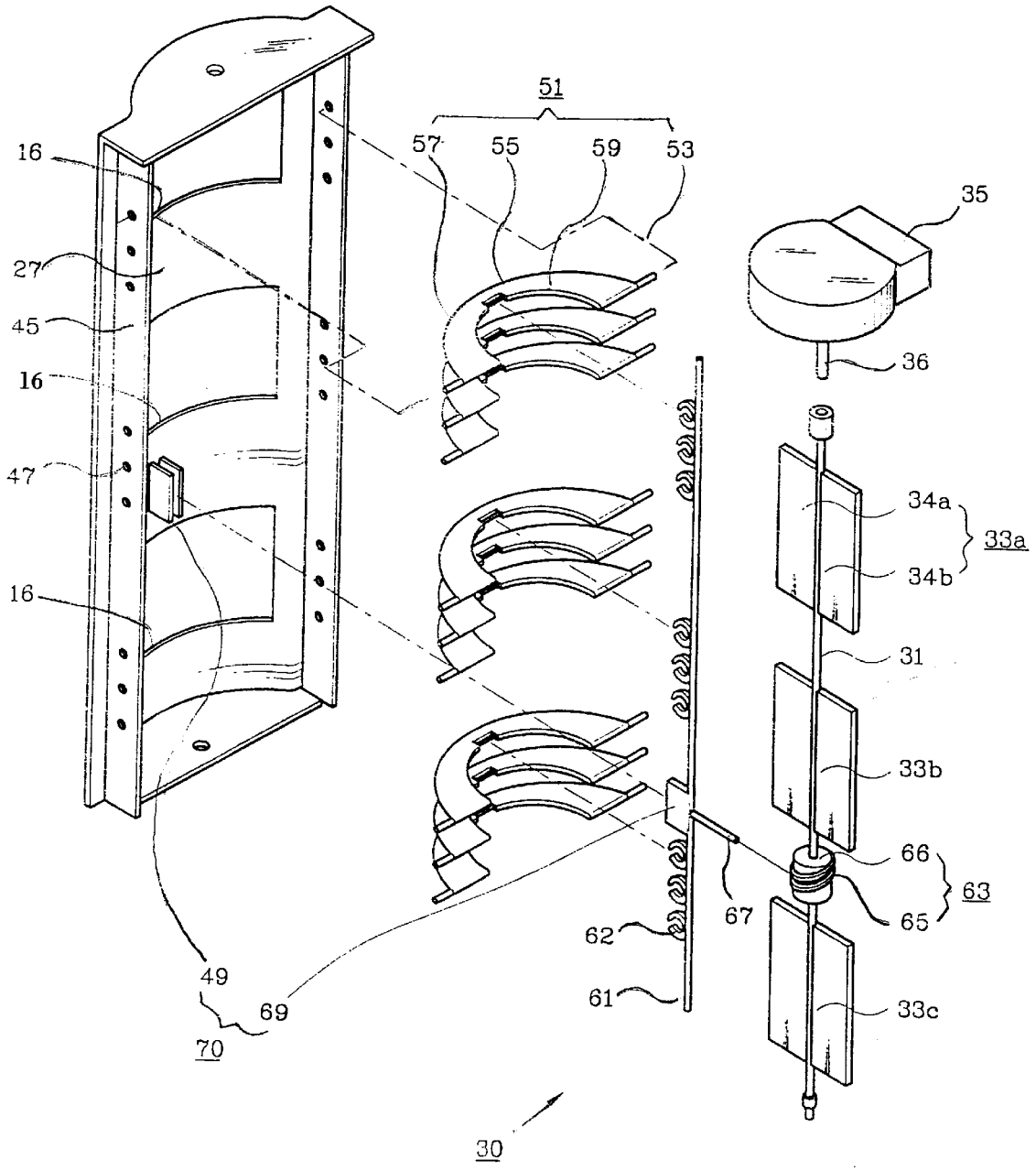
FIG. 6 is an enlarged exploded perspective view of a cool air dispersing device shown in FIG. 5.
Figure 7:
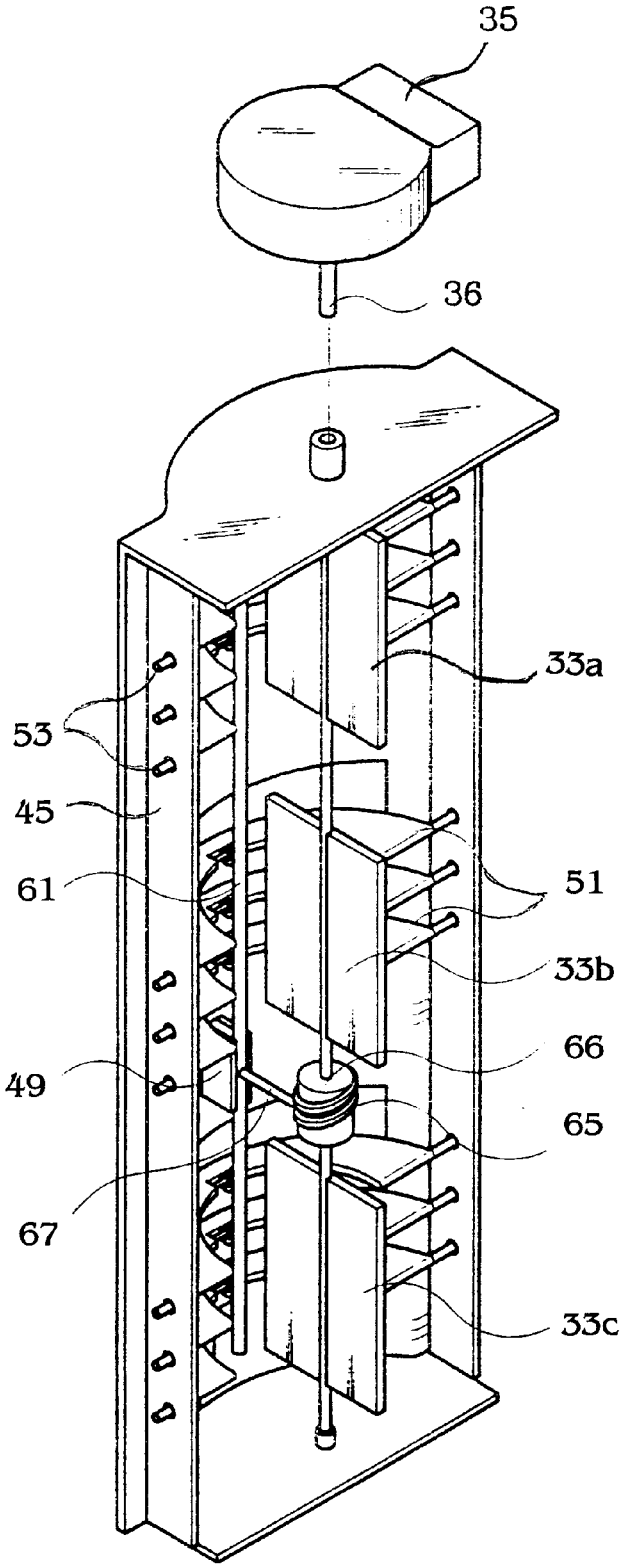
FIG. 7 is a perspective view of the assembled state of FIG. 6.

FIG. 6 is an enlarged exploded perspective view of the cool air dispersing device 30 for performing the method for controlling the cool air dispersing operation of the refrigerator according to the present invention, and FIG. 7 is a perspective view of the assembled state of FIG. 6.

The cool air dispersing device 30 according to the present invention has horizontal dispersing blades 33*a*, 33*b*, and 33*c* and vertical dispersing blades 51, which have a planar plate shape and are disposed near the cool air discharge ports 16 in the cool air duct 15, and a driving motor 35 for rotating the horizontal dispersing blades 33*a*, 33*b*, and 33*c*. The horizontal dispersing blades 33*a*, 33*b*, and 33*c* are installed on a vertical shaft 31 disposed vertically in the cool air duct 15, and are rotatable around the vertical shaft 31. Three horizontal dispersing blades 33*a*, 33*b*, and 33*c* corresponding to three discharge ports 16 are installed on the vertical shaft 31.

The horizontal dispersing blades 33*a*, 33*b*, and 33*c* control the horizontal discharge direction of the cool air in the cool air duct 15 according to the rotational position thereof, and the vertical dispersing blades 51 control the vertical discharge direction of the cool air in the cool air duct 15 according to the rotational position thereof. Furthermore, the cool air dispersing device 30 has a transmission part for reciprocally rotating the vertical dispersing blades 51 within a predetermined angular range while the horizontal dispersing blades 33*a*, 33*b*, and 33*c* are rotating.

Each of the vertical dispersing blades 51 has a front protrusion part 57 corresponding to the discharge port 16 and a rear cut part 59, and the front protrusion part 57 is formed into an arc substantially. Furthermore, each of the vertical dispersing blades 51 has horizontal shafts 53 extended sideward at both side ends thereof. Meanwhile, the duct cover 27 has flange parts 45 extended rearward at both side edges thereof, the flange parts 45 are formed with a plurality of shaft holes 47 for accommodating the horizontal shafts 53. The horizontal shafts 53 are inserted into the shaft holes 47, whereby the vertical dispersing blades 51 are supported so as to be capable of rotating vertically. In this embodiment, three vertical dispersing blades 51 are provided on every discharge port 16.

The transmission part comprises a driving cam 63 installed on the vertical shaft disposed in the rear of the vertical dispersing blades 51 in the cool air duct 15, and a link member 61 assembled with the vertical dispersing blades 51 and elevated/de-elevated by the driving cam 63 according to the rotation of the vertical shaft 31.

The vertical shaft 31 is disposed along the longitudinal direction of the cool air duct 15 in the rear of the vertical dispersing blades 51, of which upper end is assembled with the driving motor 35, and lower end is rotatably fixed to the lower part of the duct cover 27. The driving motor 35 is accommodated in a motor case (not shown) at the upper part of the front plate 23. It is preferable that the driving motor 35 is a stepping motor which is capable of rotating bilaterally and controlling the stop angular position thereof.

Each of the horizontal dispersing blades 33*a*, 33*b*, and 33*c* installed coaxially on the vertical shaft 31 has a pair of dispersing blade parts 34*a* and 34*b* disposed around the vertical shaft 31. The driving cam 63 is installed between the lower horizontal dispersing blade 33*c* and the middle horizontal dispersing blade 33*b*. The driving cam 63 has a cam body 66 installed coaxially on the vertical shaft 31, and the cam body 66 is formed with a cam groove 65 having a cam profile elevating/de-elevating along the outer surface thereof.

Meanwhile, the link member 61 has a shape of a long rod, and is disposed in parallel with the vertical shaft 31 between the vertical dispersing blades 51 and the vertical shaft 31. On the link member 61, a plurality of hinge assembly parts 62 having the shape of a partial ring and protruding toward the vertical dispersing blades 51 are provided along the longitudinal direction thereof. At the central area of the cut part 59 of the respective vertical dispersing blades 51, a hinge pin 55 corresponding to the hinge assembly parts 62 is provided. The hinge assembly parts 62 of the link member 61 and the hinge pins 55 of the vertical dispersing blades 51 are hingedly assembled with each other, whereby the vertical dispersing blades 51 can rotate vertically around the hinge pins 55 according to the elevation/de-elevation of the link member 61.

The link member 61 has an operation part 67 extended toward the driving cam 63. The operation part 67 is engaged with the cam groove 65 formed at the outer surface of the cam body 66. While the vertical shaft 31 rotates one time, the link member 61 is elevated and de-elevated one time so as to reciprocally rotate the vertical dispersing blades 51 one time.

The cool air dispersing device 30 further comprises an elevation/de-elevation guide part 70 for guiding the elevation and de-elevation of the link member 61 and at the same time preventing the rotation thereof. The elevation/de-elevation guide part 70 comprises a guide piece 69 having the shape of a plate extended from the link member 61 toward the duct cover 27, and a guide part 49 formed on the rear surface of the duct cover 27 and assembled with the guide piece 69. The guide part 49 is comprised of a pair of plates which are parallel with each other, and the guide piece 69 is inserted therebetween. The rotation of the link member 61 is prevented and the elevation/de-elevation thereof is allowed by the elevation/de-elevation guide part 70.

Hereinbelow, the method for controlling the cool air dispersing operation of the refrigerator having the above-described constriction will be described.

FIG. 8 through FIG. 13 are views showing the state of cool air dispersed by the vertical dispersing blades and the horizontal dispersing blades. After a desired temperature is set by a user, a microprocessor (not shown) in the refrigerator drives the compressor, and thereby cool air is generated around the evaporators 12*a* and 12*b*. The cool air generated by the evaporators 12*a* and 12*b* is blown by the fans 13*a* and 13*b*.

Meanwhile, the refrigerator senses the temperatures in the fresh food compartment 3 with the temperature sensors 9*a* and 9*b*. The microprocessor calculates the deviation of the temperatures in the fresh food compartment 3 on the basis of the signals from the temperature sensors 9*a* and 9*b*, and compares the deviation with a predetermined reference value preset in the microprocessor. The reference value may be determined variously according to the capacity or characteristic of the refrigerator.

Figure 8:
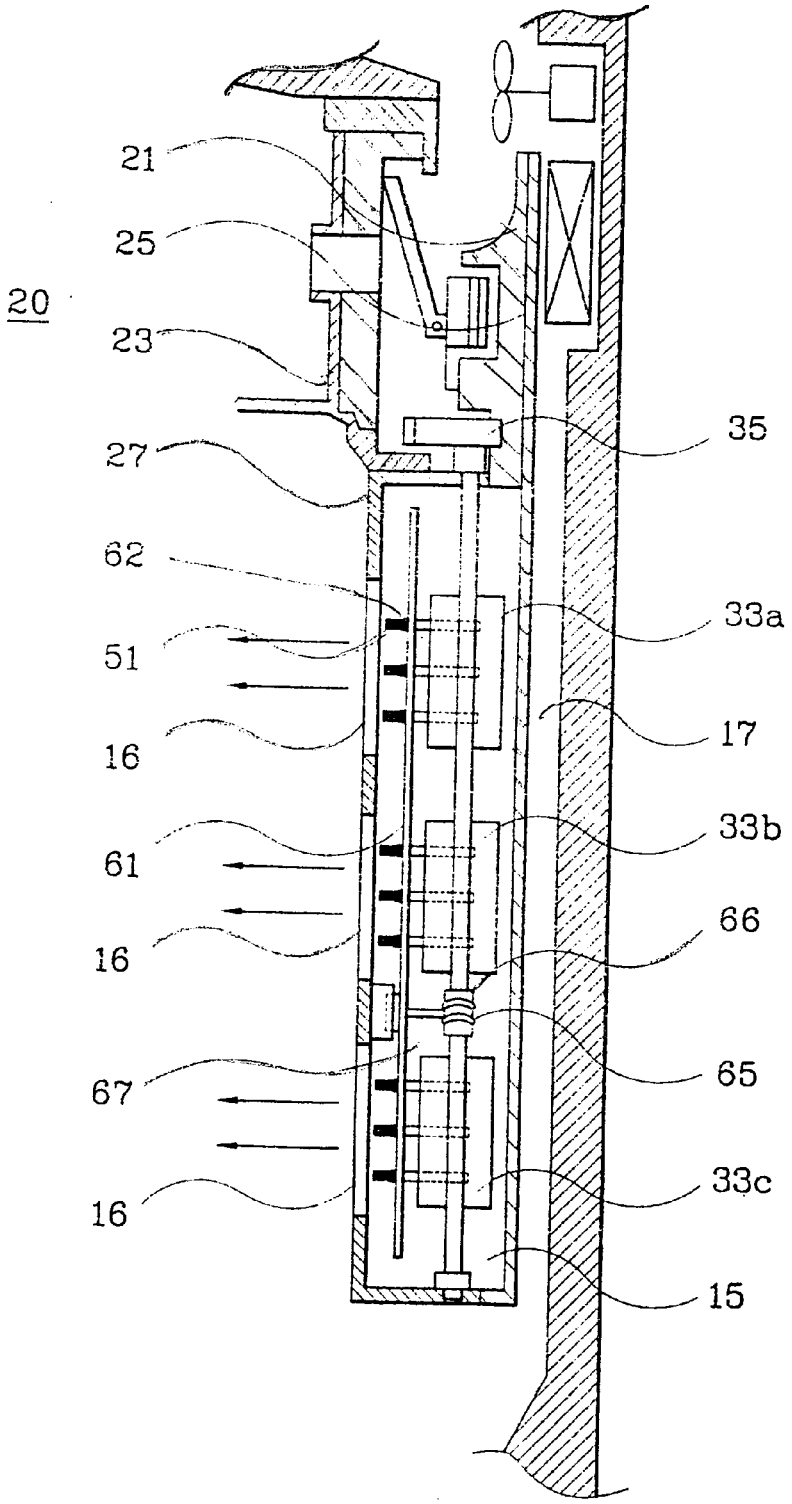
FIGS. 8 through 10 are side sectional views of FIG. 7, which show the states of cool air dispersed by the vertical dispersing blades.
Figure 9:
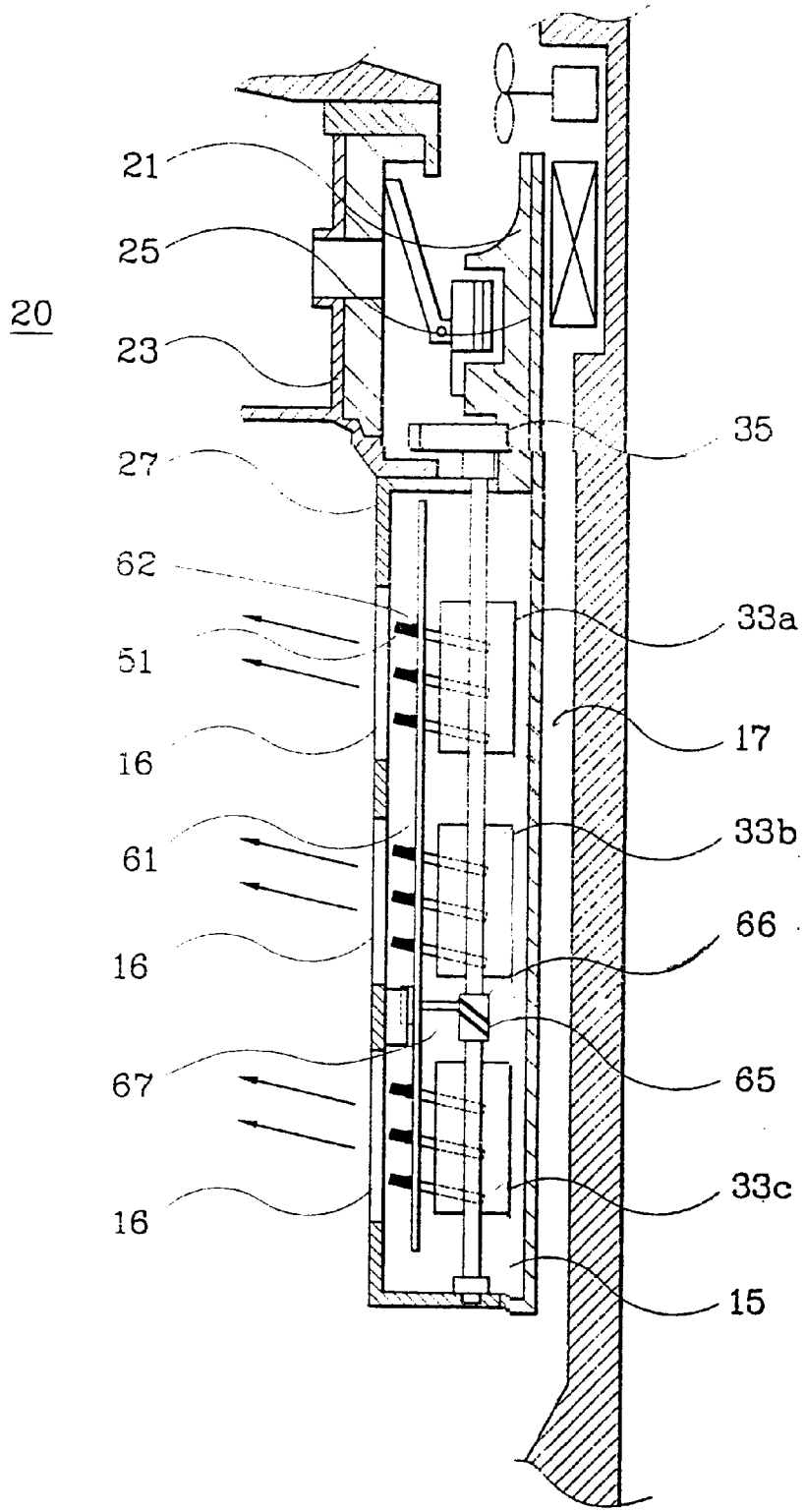
Figure 10:
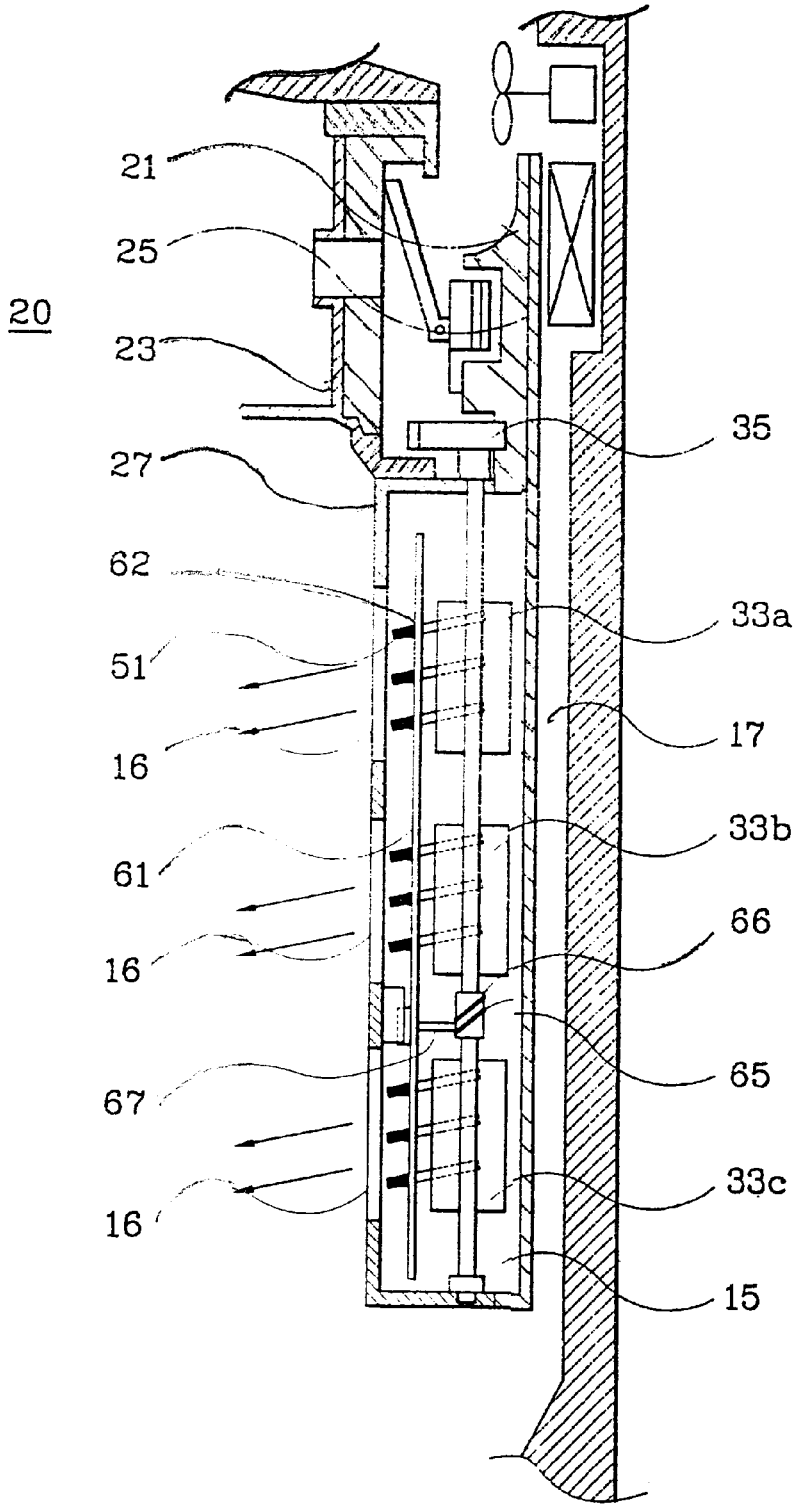

While the deviation is smaller than the reference value, the microprocessor drives the driving motor 35 so that it rotates continuously at a predetermined velocity. Then, the vertical shaft 31 assembled with the driving motor 35 and the horizontal dispersing blades 33*a*, 33*b* and 33*c* are rotated, and in such a situation, the link member 61 is elevated/de-elevated by the driving cam 63. As the link member 61 is elevated/de-elevated, as shown in FIGS. 8 through 10, the vertical dispersing blades 51 are rotated successively. When the vertical dispersing blades 51 are horizontal, the cool air is discharged frontward as shown in FIG. 8. When the vertical dispersing blades 51 are rotated upward or downward, the cool air is discharged upward or downward as shown in FIGS. 9 and 10, respectively.

Figure 11:
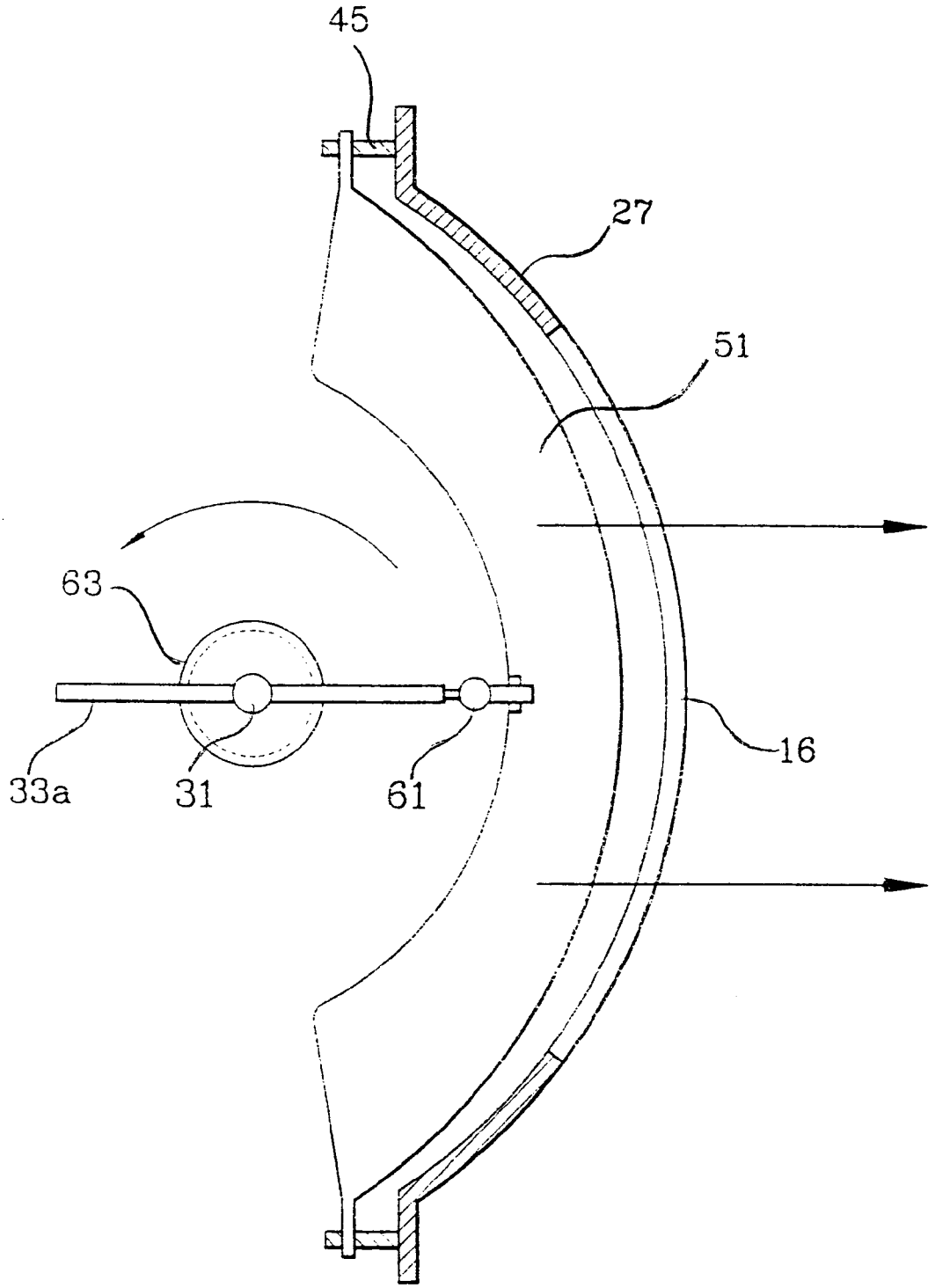
FIGS. 11 through 13 are enlarged transverse sectional views of FIG. 7, which show the states of cool air dispersed by the horizontal dispersing blades.
Figure 12:
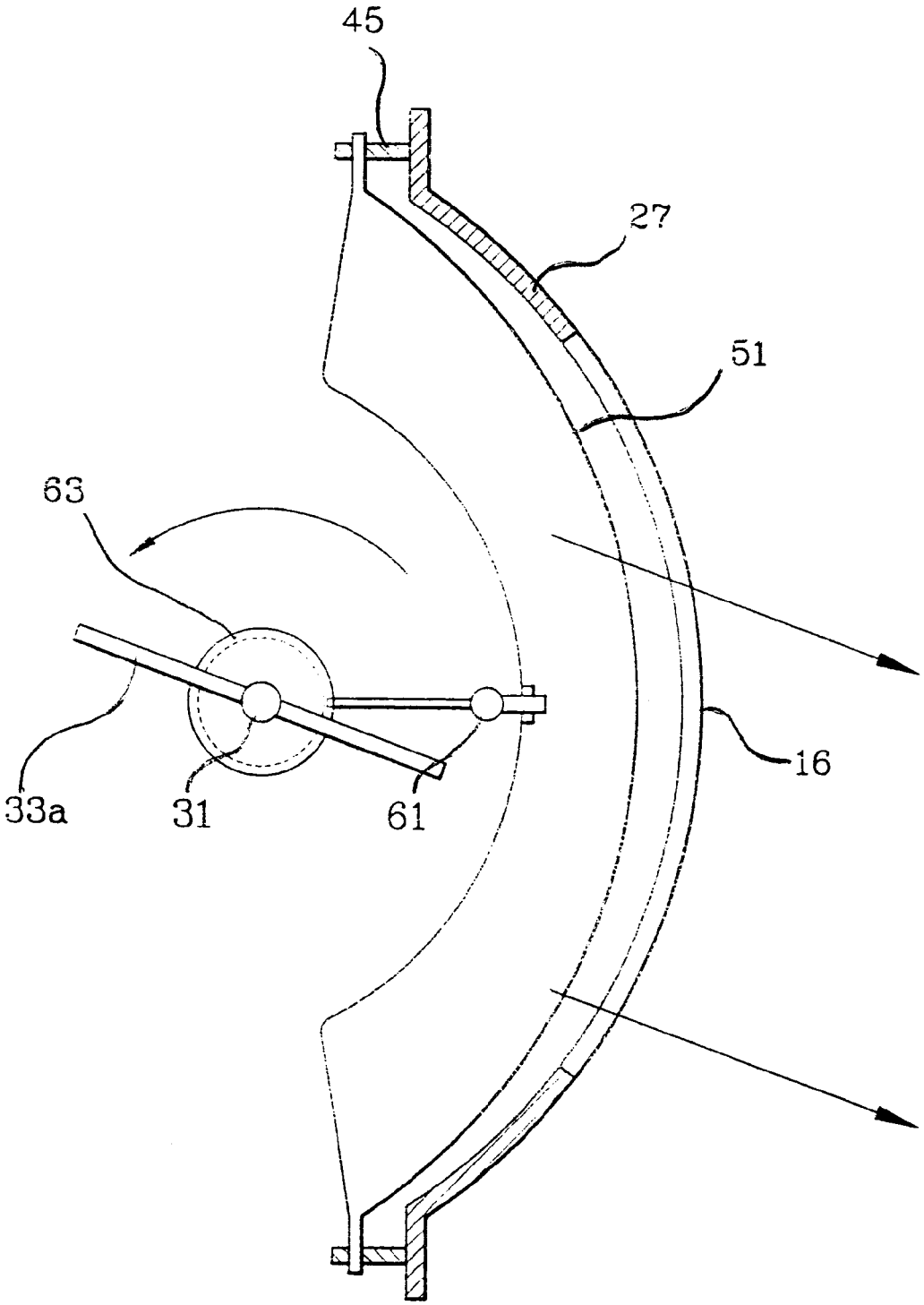
Figure 13:
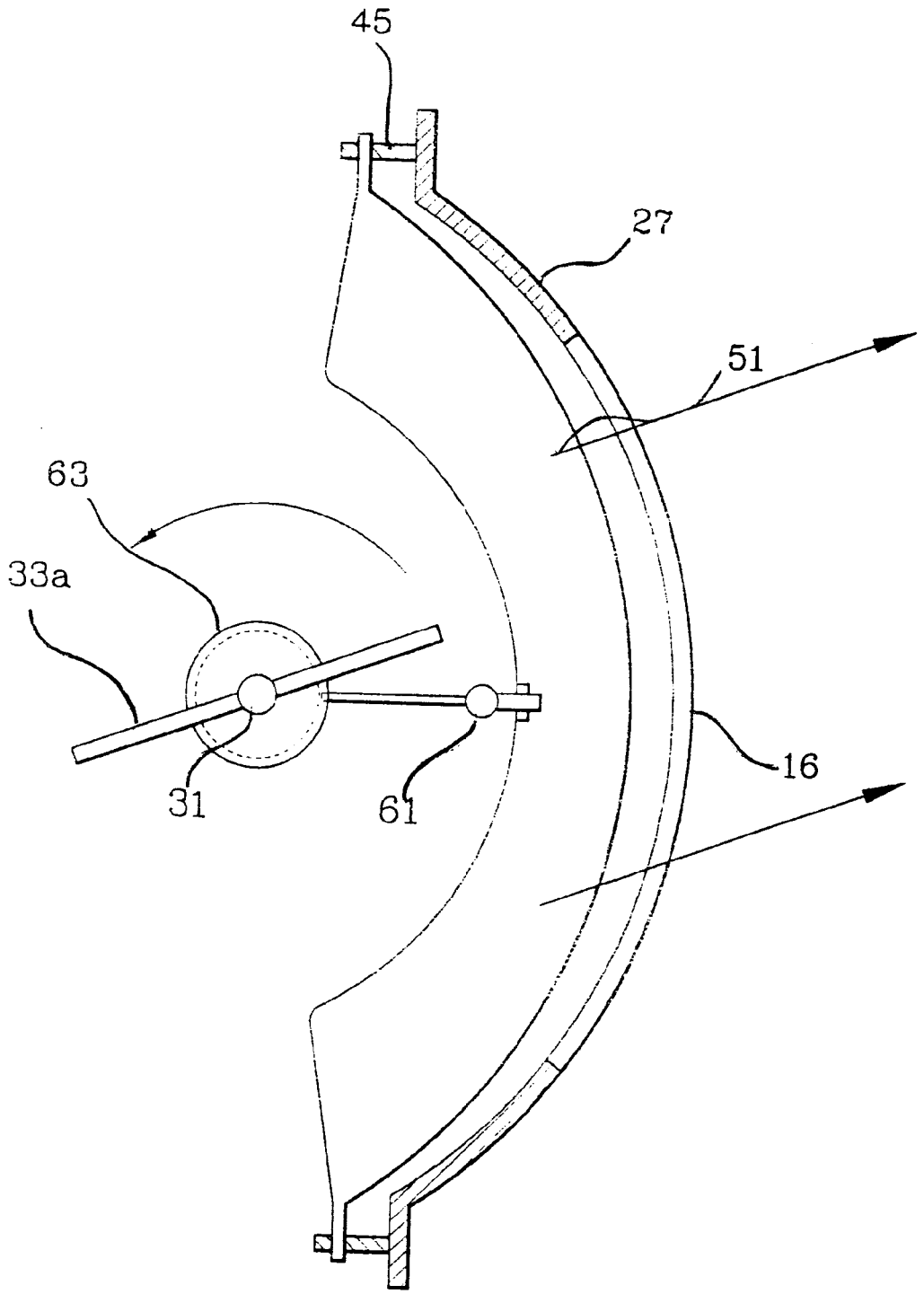

While the vertical dispersing blades 51 are rotating, the horizontal dispersing blades 33*a*, 33*b* and 33*c* are rotating. When the horizontal dispersing blades 33*a*, 33*b* and 33*c* are positioned frontward as shown in FIG. 11, the cool air is discharged frontward. When the horizontal dispersing blades 33*a*, 33*b* and 33*c* are rotated right or left, the cool air is discharged right or left as shown in FIGS. 12 and 13, respectively.

Figure 14:
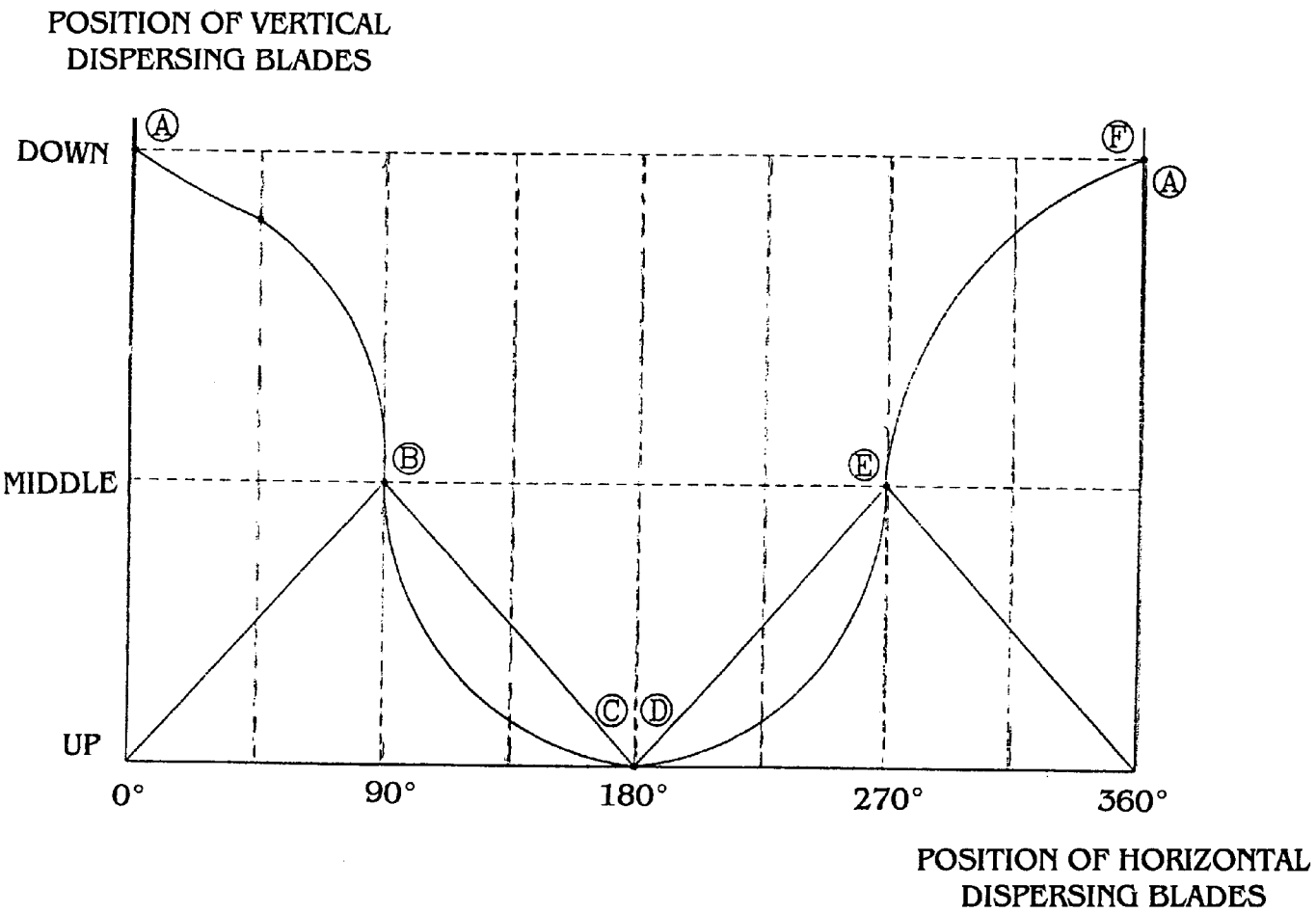
FIG. 14 is a graph showing the rotational positions of the horizontal dispersing blades and vertical dispersing blades.
Figure 15:
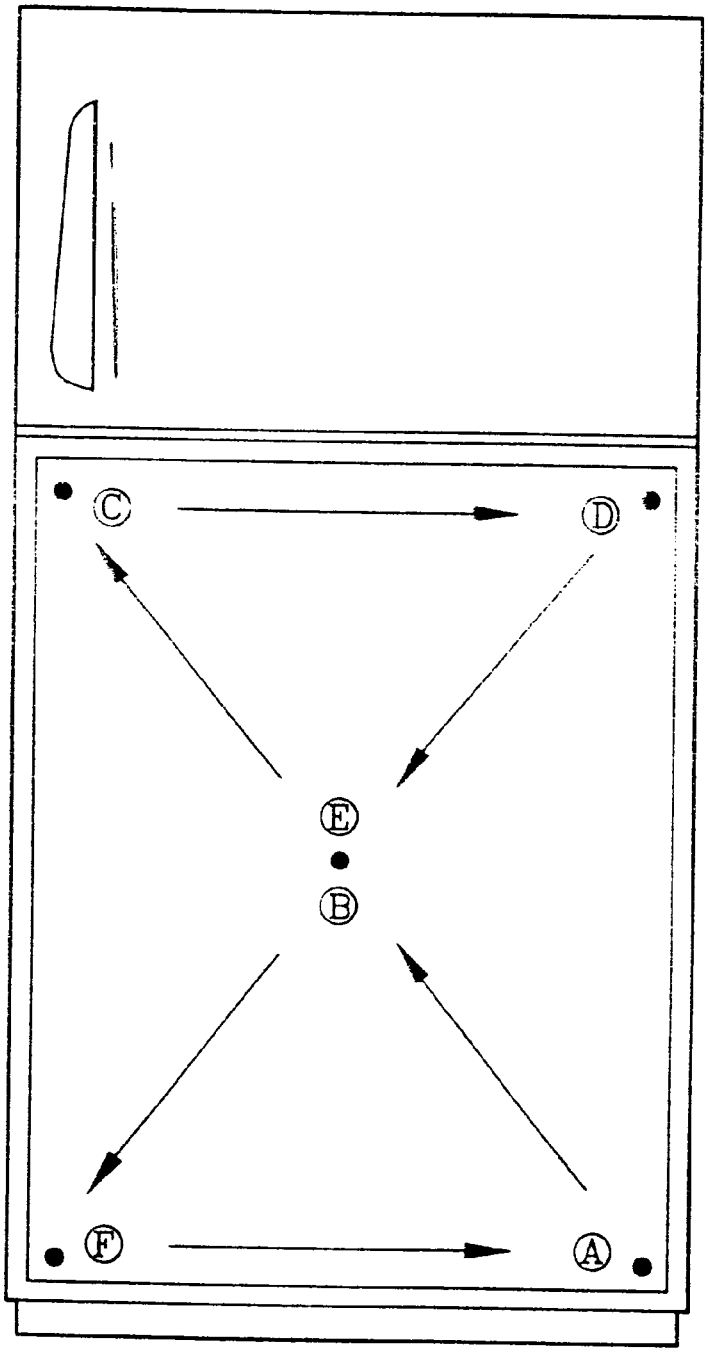
FIG. 15 is a schematic front view of a refrigerator, which shows the areas in a cooling compartment to which the cool air is successively discharged.

As described above, while the cool air dispersing device 30 according to the present invention is operating, the cool air is successively discharged to respective areas in the fresh food compartment 3 by the combinational operation of the vertical dispersing blades 51 and the horizontal dispersing blades 33*a*, 33*b* and 33*c*. FIGS. 14 and 15 show the areas in the fresh food compartment (area A through area F) to which the cool air is successively supplied by such a cool air dispersing device 30.

While one dispersing blade part 34*a* of the horizontal dispersing blades 33*a*, 33*b* and 33*c* is rotated right, the vertical dispersing blades 51 are rotated downward, whereby the cool air in the cool air duct 15 is discharged to the right lower area A in the fresh food compartment 3. While the one dispersing blade part 34*a* is directed frontward, the vertical dispersing blades 51 are also directed frontward, whereby the cool air in the cool air duct 15 is discharged to the central area B in the fresh food compartment 3. While the dispersing blade part 34*a* is rotated left, the vertical dispersing blades 51 are rotated upward, whereby the cool air in the cool air duct 15 is discharged to the left upper area C in the fresh food compartment 3.

As the vertical shaft 31 further rotates, the other dispersing blade part 34*b* of the horizontal dispersing blades 33*a*, 33*b* and 33*c* becomes rotated right, and the vertical dispersing blades 51 are still rotated upward, whereby the cool air is discharged right upper area D in the fresh food compartment 3. As the other dispersing blade 34*b* continues to rotate left, the vertical dispersing blades 51 gradually rotate downward, whereby the cool air in the cool air duct 15 is discharged to the central area E, and then to the left lower area F successively.

Afterward, the cool air is supplied to the right lower area A again by the dispersing blades part 34*a* and the vertical dispersing blades 51, and such a process is repeated while the vertical shaft 31 is being rotated by the driving motor 35. The temperature in the fresh food compartment 3 is maintained uniform by the cool air discharged thereinto along a predetermined continuous circulating path as described above.

Meanwhile, when the deviation of temperatures in the fresh food compartment 3 is greater than the predetermined reference value, the microprocessor controls the horizontal dispersing blades 33*a*, 33*b* and 33*c* and the vertical dispersing blades 51 on the basis of the signals from the temperature sensors 9*a* and 9*b* so that the cool air is concentrated on an area of which temperature is high. For example, if the temperature of the right lower area A in the fresh food compartment 3 is determined to be highest, the microprocessor drives the driving motor 35 so that the horizontal dispersing blades 33*a*, 33*b* and 33*c* and the vertical dispersing blades 51 are directed to the right lower area A, and then stops the driving motor 35. Then, the cool air is continuously supplied to the right lower area A, and the temperature in the fresh food compartment 3 becomes uniform in a short period of time.

As described above, according to the present invention, the vortex of the cool air about the cool air discharge ports does not occur since the horizontal dispersing blades and the vertical dispersing blades have the shape of a planar plate. Further, since the discharge direction of the cool air is continuously changed by the combinational operation of the horizontal dispersing blades and the vertical dispersing blades, the cool air is distributed uniformly throughout the overall area of the fresh food compartment. In particular, the area of which temperature has risen can be cooled in a concentrative manner, so the temperature in the fresh food compartment becomes uniform in a short period of time.

Although the present invention has been described and illustrated in detail, it is clearly understood that the same is by way of illustration and example only and is not to be taken by way of limitation, wherein the spirit and scope of the present invention is limited only by the terms of the appended claims.

What is claimed is:

1. A method for controlling a cool air dispersing operation of a refrigerator, comprising the steps of:

preparing a duct housing forming a cool air duct for guiding cool air generated by an evaporator, said duct housing having a plurality of cool air discharge ports open into a cooling compartment, a plurality of horizontal dispersing blades of planar plate shape being installed in said cool air duct so as to be capable of rotating with respect to a vertical axis, said horizontal dispersing blades for controlling a horizontal discharge direction of the cool air supplied into said cooling compartment, and a plurality of vertical dispersing blades of planar plate shape being installed in said cool air duct so as to be capable of rotating with respect to a horizontal axis, said vertical dispersing blades for controlling a vertical discharge direction of the cool air supplied into said cooling compartment;

sensing temperatures of a predetermined number of positions in said cooling compartment;

calculating a deviation of the temperatures in said cooling compartment on the basis of the sensed temperature;

supplying the cool air in said cool air duct successively to respective areas in said cooling compartment by rotating said horizontal dispersing blades and said vertical dispersing blades continuously, while the deviation is smaller than a predetermined value; and stopping said horizontal dispersing blades and said vertical dispersing blades so that the cool air is discharged toward an area of which temperature is high, when the deviation is greater than the predetermined value.

2. The method for controlling a cool air dispersing operation of a refrigerator as claimed in claim 1, wherein said vertical dispersing blades are reciprocally rotated within a predetermined angular range as said horizontal dispersing blades are rotated.

3. The method for controlling a cool air dispersing operation of a refrigerator as claimed in claim 2, wherein said vertical dispersing blades are controlled so as to reciprocate one time while said horizontal dispersing blades rotate one time.

* * * * *